United States Patent [19]

Klüttermann

[11] 4,404,711

[45] Sep. 20, 1983

[54] APPARATUS FOR WITHDRAWING AND GATHERING A FIBER WEB

[75] Inventor: Jürgen Klüttermann, Monchen-Gladbach, Fed. Rep. of Germany

[73] Assignee: Trützschler GmbH & Co. KG, Monchen-Gladbach, Fed. Rep. of Germany

[21] Appl. No.: 294,003

[22] Filed: Aug. 18, 1981

[51] Int. Cl.[3] ..... D01G 15/46

[52] U.S. Cl. ..... 19/106 R; 19/65 CR; 19/288

[58] Field of Search ..... 19/106 R, 65 CR, 288

[56] References Cited

U.S. PATENT DOCUMENTS 4,213,553 7/1980 Leifeld ..... 226/196

FOREIGN PATENT DOCUMENTS 2931568 2/1981 Fed. Rep. of Germany .... 19/106 R

*Primary Examiner*—Louis Rimrodt

*Attorney, Agent, or Firm*—Spencer, Kaye & Frank

[57] ABSTRACT

A carding machine has a doffer, a web delivering assembly cooperating with the doffer, a calender unit arranged for receiving a fiber web discharged by the web delivering assembly. The calender unit includes a sliver trumpet and calender rolls. The calender unit is displaceable between an operative position in which the sliver trumpet is situated in the immediate vicinity of the web delivering assembly and an inoperative position in which the sliver trumpet is remote from the web delivering assembly. A start-up tray is movably supported underneath the doffer and the web delivering assembly. The start-up tray guides leading portions of the fiber web from the doffer to the web delivering assembly during start-up operation. The start-up tray is coupled to the calender unit such that the start-up tray is moved by the calender unit into a start-up position when the calender unit moves into its inoperative position and the start-up tray is moved by the calender unit into the withdrawn position when the calender unit moves into its operative position.

6 Claims, 4 Drawing Figures

APPARATUS FOR WITHDRAWING AND GATHERING A FIBER WEB

BACKGROUND OF THE INVENTION

This invention relates to an apparatus for withdrawing a fiber web discharged by a web delivering assembly of a carding machine and for gathering the web to form a sliver. The apparatus includes a sliver trumpet equipped with calender rolls and arranged downstream of the web delivering assembly, as viewed in the direction of web discharge.

Generally, the web delivering assembly, such as the crush rolls of a carding machine, discharge an extremely thin fiber web which is composed of interlocked individual fibers and which has a width of approximately 1,000 mm. The fiber web is thus exposed along a great width to the effect of air currents and further, the web has to be gathered into a rope-like sliver from such a large width dimension. The weight of the web is only about 5 g/m$^2$, so that within the fiber web there are only very weak cohesion forces and therefore the running speed has to be significantly limited. Close the crush rolls, there is arranged a sliver trumpet which gathers the web into a sliver. Between the crush rolls and the trumpet the web is of triangular configuration. This method has the disadvantage that the running speed of the fiber web, as it emerges from the crush rolls, has to remain—in the absence of appropriate measures—relatively small to avoid fiber web rupture. In U.S. Pat. No. 4,213,553 (Ferdinand Leifeld) issued July 22, 1980, an arrangement is disclosed wherein the sliver trumpet may be brought in the immediate vicinity of the web delivering assembly for normal operation of a card. As a result, the web passes directly from the web delivering assembly to the sliver, thus largely eliminating adverse effects of air currents. The calender unit which comprises the sliver trumpet and the calender rolls is movable towards and away from the crush rolls to assume an operative position in the immediate vicinity of the crush rolls in the normal run and an inoperative, withdrawn position for start-up, maintenance or cleaning.

For facilitating start-up operation which involves the passing of the leading end of the web through the various roll components, it is known to use a start-up tray which is situated underneath the crush rolls (and a stripper roll preceding the crush rolls) for guiding the leading end of the web in between the crush rolls. After start-up, for the normal operational run, the calender assembly is brought into its normal operational position close to the crush rolls and the delivery speed is increased. During normal operation, however, the presence of the start-up tray is not desired, because debris dropping out of the web in the zone of the stripping roll and the crush rolls may accumulate on the start-up tray and may therefore interfere with the operation of the card.

SUMMARY OF THE INVENTION

It is an object of the invention to provide an improved apparatus of the above-outlined type which automatically provides that the start-up tray is in its operative position only for the start-up phase of the carding run.

This object and others to become apparent as the specification progresses, are accomplished by the invention, according to which, briefly stated, the calender unit (comprising the sliver trumpet and the calender rolls) is displaceable to assume a normal operational position in the close vicinity of the web delivering assembly and a remote, inoperative position which the unit assumes after stoppage for example, for maintenance and repairs. According to the invention, the start-up tray is operatively coupled to the calender unit such that when the calender unit is in its inoperative position, the start-up tray assumes its closed operative position underneath the web delivering assembly, whereas a displacement of the calender unit into its normal operational position in the immediate vicinity of the web delivering assembly causes the start-up tray to move away into an inoperative position in which the start-up tray does not collect any fragments or debris which may fall from the web during normal operation.

DESCRIPTION OF THE PREFERRED EMBODIMENTS

Figure 1A:
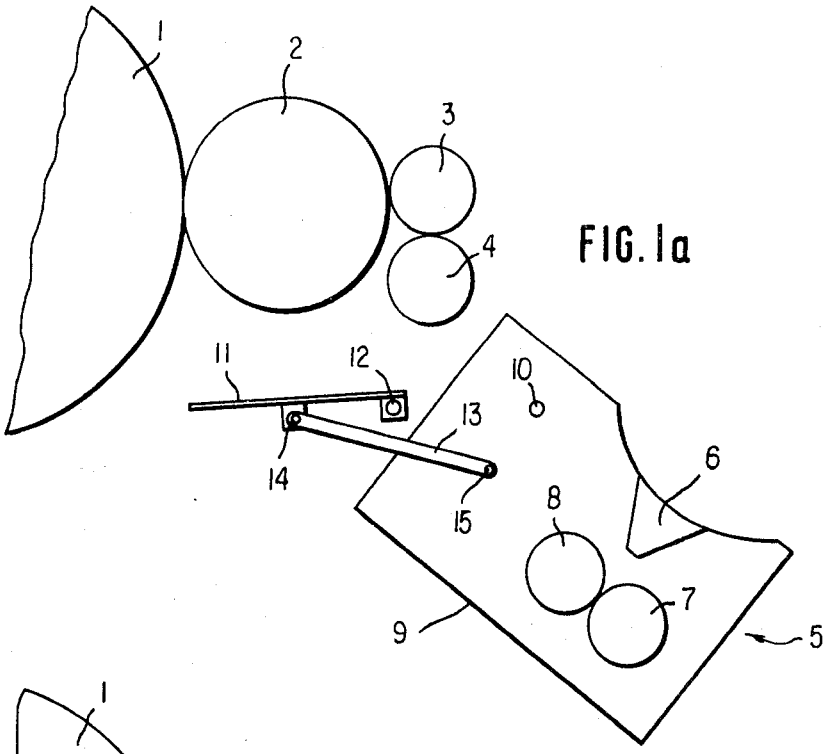
FIGS. 1*a* and 1*b* are schematic side elevational views of a preferred embodiment of the invention showing components in two different operational positions.
Figure 1B:
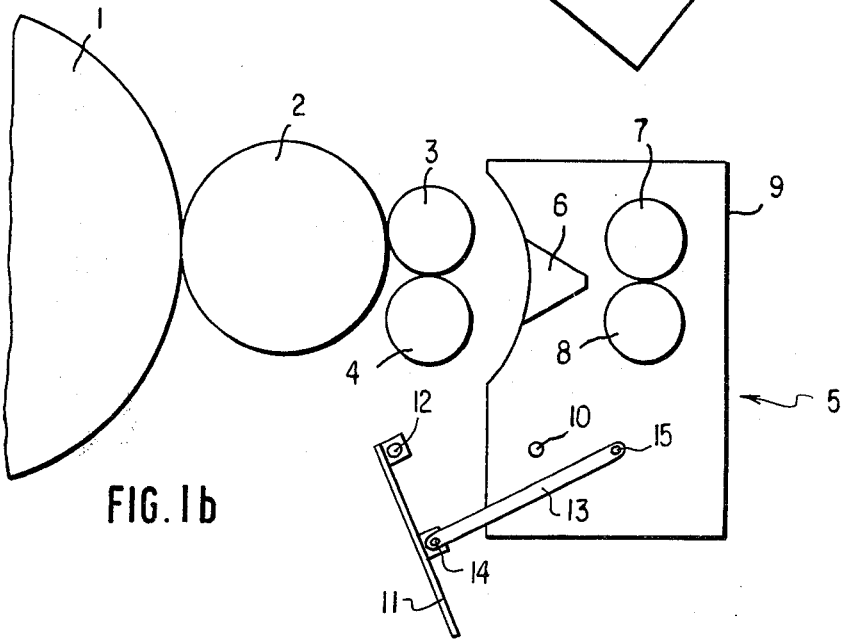

Turning now to FIGS. 1*a* and 1*b*, there is shown a doffer 1, a stripping roll 2 as well as cooperating crush rolls 3 and 4 of a carding machine. A calender unit generally indicated at 5 comprises a sliver trumpet 6 and two calender rolls 7 and 8. The sliver trumpet 6 as well as the calender rolls 7 and 8 are mounted in a housing 9 which, in turn, is swingably supported in the card frame by means of a pivot 10.

Underneath the stripping roll 2 and the crush rolls 3 and 4 there is arranged a start-up tray 11 which is pivotally supported by means of a pin 12 in the carding frame for swinging motion in a substantially vertical plane. A coupling bar 13 is, at one end, articulated at 14 to the start-up tray 11 at a location spaced from the pivot 12, while the other end of the coupling bar 13 is articulated at 15 to the housing 9.

By virtue of the above-described articulation between the start-up tray 11 and the calender unit housing 9 when the latter is swung about the pivot 10, a pivotal motion of the start-up tray 11 about the pivot 12 will likewise occur.

Before starting the carding operation, the calender unit 5 is in its inoperative, swung-away position shown in FIG. 1*a*. At the same time, the start-up tray 11 is in its operative position as shown in FIG. 1*a*.

The purpose of providing the start-up tray 11 is to assist the leading end of the fiber web to be passed between the crush rolls 3 and 4 during start-up run. The crush rolls 3 and 4, not being provided with a clothing, are by themselves not capable of grasping the web as it is delivered by the stripping roll 2 in the initial stage of operation. Thus, in the operative (horizontal) position of the start-up tray 11, as shown in FIG. 1*a*, the web, as it is discharged by the stripping roll 2, accumulates on the start-up tray 11 and, as the web mass on the start-up tray 11 reaches a certain height, it may be readily grasped and drawn-in by the crush rolls 3 and 4.

After the fiber web has been grasped by the crush rolls 3 and 4, the start-up tray 11 has accomplished its function and is not needed for the normal operation of the card. It is, however, a desideratum not to maintain the start-up tray 11 in its operative position, because during normal operation, fragments and other debris may fall from the web as it passes from the stripping roll 2 to the crush rolls 3 and 4 and cause an accumulation of impurities on the start-up tray 11; this occurrence may interfere with a proper operation of the card.

A displacement of the start-up tray 11 from its operative position into a withdrawn, inoperative position is effected automatically when the calender assembly 5 is pivoted counterclockwise from its withdrawn, inoperative position shown in FIG. 1*a*, into its operative position in which the sliver trumpet 6 assumes a position in the close vicinity of the crush rolls 3 and 4. Such a motion causes, by virtue of the coupling bar 13, a pivotal motion of the start-up tray 11 in a counterclockwise direction about the pivot 12, into a substantially vertical position as shown in FIG. 1*b*. It will be readily apparent that in this position the start-up tray 11 will not collect any fiber fragment or debris but will allow such components to freely fall into collectors (not shown) arranged underneath the start-up tray 11.

Figure 2A:
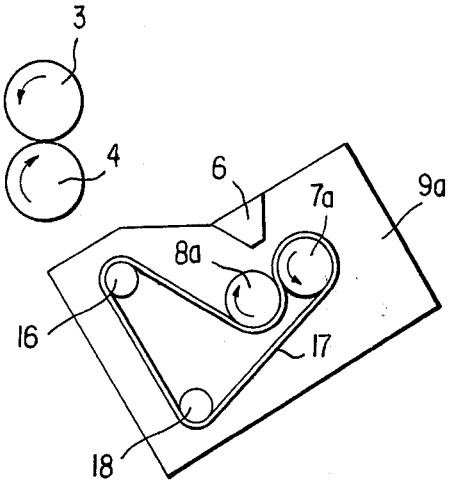
FIGS. 2*a* and 2*b* are schematic side elevational views of a variant of the preferred embodiment showing components in two different operational positions.
Figure 2B:
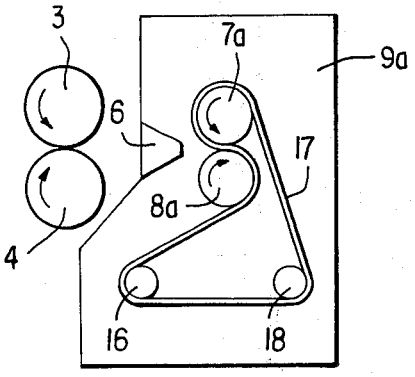

Turning now to FIGS. 2*a* and 2*b*, there is shown a calender assembly 5*a* which, similarly to the calender assembly 5 of the previously described embodiment, comprises a trumpet 6 as well as calender rolls 7 and 8 mounted in a housing 9*a*. This embodiment differs essentially from the embodiment illustrated in FIGS. 1*a* and 1*b* only in that the component which pivotally secures the calender assembly 5*a* to the card frame is constituted by a roller 16 which simultaneously functions as a component of the drive for the calender rolls 7 and 8. The roller 16 continues as a shaft (not shown) which is operatively connected with the doffer drive (also not shown) of the carding machine. An endless drive belt 17 is trained about the roller 16, axial extensions 7*a* and 8*a* of the calender rolls as well as a deflecting roller 18, whereby the calender rolls 7 and 8 are driven by the roller 16.

While not illustrated in FIGS. 2*a* and 2*b*, the start-up tray 11 is articulated to the housing 9*a* in a manner identical to the articulation shown and described in connection with FIGS. 1*a* and 1*b*.

It will be understood that the above description of the present invention is susceptible to various modifications, changes and adaptations, and the same are intended to be comprehended within the meaning and range of equivalents of the appended claims.

What is claimed is:

1. In a carding machine including a doffer, a web delivering assembly cooperating with the doffer, a calender unit arranged for receiving a fiber web discharged by the web delivering assembly; said calender unit including a sliver trumpet receiving the fiber web from said web delivering assembly and calender rolls receiving a sliver from said sliver trumpet; said calender unit being displaceably supported for assuming an operative position in which said sliver trumpet is situated in the immediate vicinity of said web delivering assembly and an inoperative position in which said sliver trumpet is remote from said web delivering assembly; and a start-up tray supported underneath said doffer and said web delivering assembly; the improvement comprising mounting means for movably supporting said start-up tray for assuming a start-up position in which, during start-up run, said start-up tray guides leading portions of the fiber web from said doffer to said web delivering assembly and a withdrawn position in which said start-up tray leaves the space underneath said doffer and said web delivering assembly substantially unobstructed; and coupling means connecting said start-up tray with said calender unit for moving said start-up tray by said calender unit into said start-up position when said calender unit moves into its inoperative position and for moving said start-up tray by said calender unit into said withdrawn position when said calender unit moves into its operative position.

2. A carding machine as defined in claim 1, further comprising a pivot arrangement for swingably supporting said calender unit.

3. A carding machine as defined in claim 2, further comprising a driving means for rotating said calender rolls; said driving means comprising a drive roller and an endless belt trained about said drive roller and said calender rolls; said drive roller constituting said pivot arrangement for said calender unit.

4. A carding machine as defined in claim 2, wherein said mounting means includes a further pivot arrangement for swingably supporting said start-up tray.

5. A carding machine as defined in claim 4, wherein said coupling means comprises a coupling bar articulated, at spaced locations thereof, to said start-up tray and to said calender unit.

6. A carding machine as defined in claim 5, further wherein said calender unit comprises a housing supporting said sliver trumpet and said calender rolls; said coupling bar being articulated to said housing.

* * * * *